US006328573B1

(12) United States Patent
Sakata et al.

(10) Patent No.: US 6,328,573 B1
(45) **Date of Patent: *Dec. 11, 2001**

(54) INTERMEDIATE ELECTRICAL CONNECTOR

(75) Inventors: Tsuyoshi Sakata; Tsutomu Matsuo; Takashi Nagawatari, all of Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/515,388

(22) Filed: Feb. 29, 2000

(51) Int. Cl.[7] ..... H01R 12/00
(52) U.S. Cl. ..... 439/66
(58) Field of Search ..... 439/66, 70, 71

(56) References Cited

U.S. PATENT DOCUMENTS

| | | | | |
|---|---|---|---|---|
| 5,139,427 | * | 8/1992 | Boyd et al. | 439/66 |
| 5,308,252 | * | 5/1994 | Mroczowski et al. | 439/66 |
| 5,395,252 | * | 3/1995 | White | 439/66 |
| 5,800,184 | * | 9/1998 | Lopergolo et al. | 439/66 |
| 5,957,703 | * | 9/1999 | Arai et al. | 439/66 |
| 6,062,871 | * | 5/2000 | Arai et al. | 439/66 |

* cited by examiner

*Primary Examiner*—Tulsidas Patel
(74) *Attorney, Agent, or Firm*—Kanesaka & Takeuchi

(57) ABSTRACT

An intermediate electrical connector comprises a housing (1) having apertures (2A, 3A) and a contact element (4) which comprises a retention section (5) held between the peripheries of the apertures (2A, 3A), a pair of contact sections (6A, 6B) projecting from the apertures (2A, 3A) in opposite directions, and a transmission path (7) provided between the contact sections (6A, 6B).

5 Claims, 9 Drawing Sheets

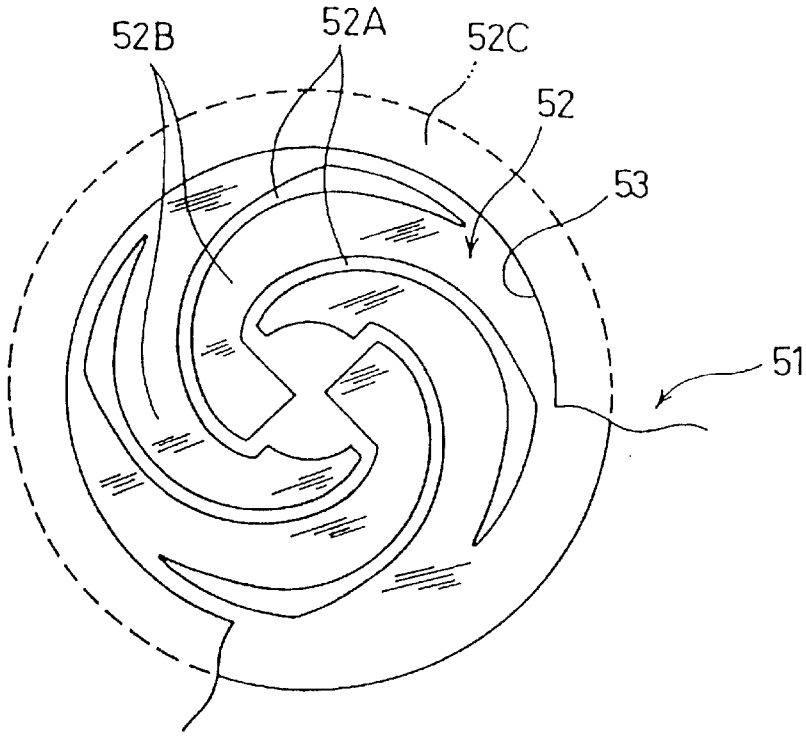
Fig. 9 (A) PRIOR ART
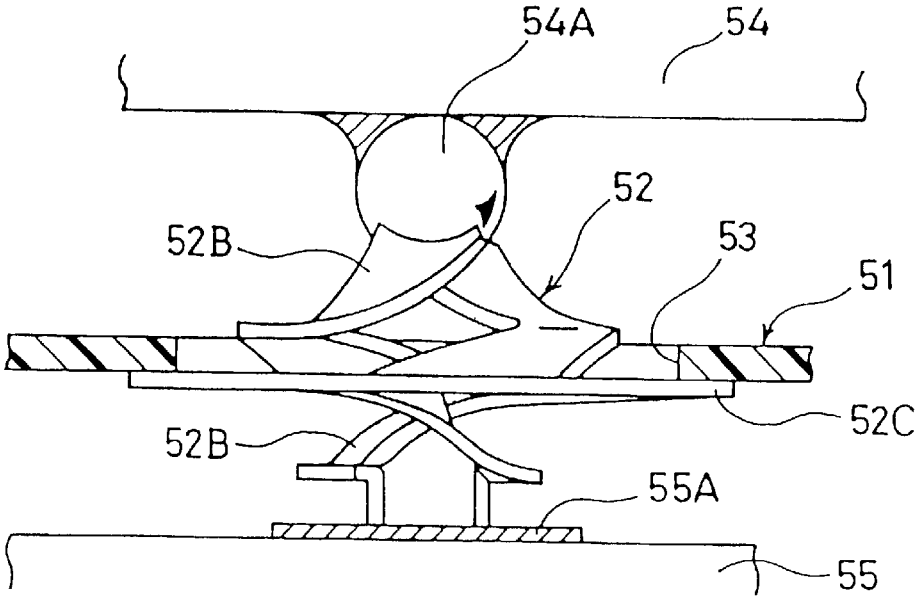
Fig. 9 (B) PRIOR ART

INTERMEDIATE ELECTRICAL CONNECTOR

BACKGROUND OF THE INVENTION

1. Field of the Invention

The present invention relates to intermediate electrical connectors provided between two connection objects to electrically connect them.

2. Related Art

Japanese patent application Kokai No. 8-330005 discloses such an intermediate electrical connector. As FIGS. 9(A) and (B) show, a contact element 52 is attached to an insulating board 51 through an aperture 53. The contact element 52 has a circular section of metallic sheet with a diameter larger than that of the aperture 53. It is provided with a plurality of spiral grooves 52A to form a plurality of spiral contact pieces 52B. The periphery 52C of the contact element 52 is fixed to the insulating board 51 such that the spiral contact pieces 52B project from the apertures alternately in opposite directions.

In use, as shown in FIG. 9(B), the upwardly extending contact pieces 52B are brought into contact with a spherical contact section 54A of an upper connection object 54 while the downwardly extending contact pieces 52B are brought into contact with a flat contact section of a lower connection object 55, thereby electrically connecting the two connection objects 54 and 55.

However, the above device has the following disadvantages.

(1) The length of electrical path between the tips of the contact pieces is so large that the inductance and electrical resistance are considerably high. The high inductance causes crosstalk or ground bounce at high signal speeds. The high resistance causes high power consumption, producing large amounts of heat.

(2) There is no wiping effects caused by the contact pressure at the contact area between the contact element and the mating connection object. Consequently, when a film of dirt is formed on the contact surface, no automatic cleaning action is obtained upon contact, thus failing to provide a stable contact.

(3) A plurality of transmission paths are formed so that any difference in the length of the paths causes a signal delay.

SUMMARY OF THE INVENTION

Accordingly, an object of the invention is to provide an intermediate electrical connector which has a short transmission path and wiping effects and a process for producing such a connector.

According to the invention there is provided an intermediate electrical connector which comprises a plate-like housing having at least one aperture and a contact element supported by the housing for electrically connecting a pair of connection objects provided on opposite sides of the housing.

The contact element comprises a pair of retention sections provided at opposite ends of the contact element and held by the housing; a pair of U-shaped contact sections, one end of each of the contact sections being connected to each of the retention sections; and a transmission path connected between the other ends of the contact sections such that the contact sections project from the aperture.

Since the two contact sections are provided in the middle section, the distance between them is shortened. In addition, the contact sections are not situated at the center of the contact element so that when they are flexed upon contact, the contact sections make sliding contact, producing wiping effects. Furthermore, there is provided only one transmission path so that there is no problem with signal delay.

It is preferred that the transmission path is substantially straight. Also, it is preferred that the retention sections are located outside the aperture. It is preferred that the housing consists of two layers between which the retention sections are held.

According to another aspect of the invention there is provided a process for producing an intermediate electrical connector, which comprises the steps of forming at least one aperture in each of first and second insulating sheets at a corresponding position; attaching a metal sheet to the first insulating sheet so as to cover the aperture; etching the metal sheet to form a flat contact element; attaching the second insulating sheet to the first insulating sheet such that the apertures in the first and second insulating sheets are aligned; and subjecting the flat contact element to vertical plastic deformation to form a pair of contact sections which project from the aperture in opposite directions.

According to still another aspect of the invention there is provided a process for producing an intermediate electrical connector, which comprises the steps of forming at least one aperture in each of first and second insulating sheets at a corresponding position; forming a series of flat contact elements of metal sheet; attaching the series of flat contact elements to the first insulating sheet; removing linking sections between the flat contact elements to form individual flat contact elements attaching the second insulating sheet to the first insulating sheet such that the apertures in the first and second insulating sheets are aligned; and subjecting each of the flat contact elements to vertical plastic deformation to form a pair of contact sections which project from the aperture in opposite directions.

BRIEF DESCRIPTION OF THE DRAWINGS

FIG. 9(A) is a top plan view of a conventional intermediate electrical connector; and FIG. 9(B) is a side view, partially in section, of the conventional intermediate electrical connector.

DESCRIPTION OF THE PREFERRED EMBODIMENTS

An embodiment of the invention will now be described with reference to FIGS. 1–8.

Figure 1:
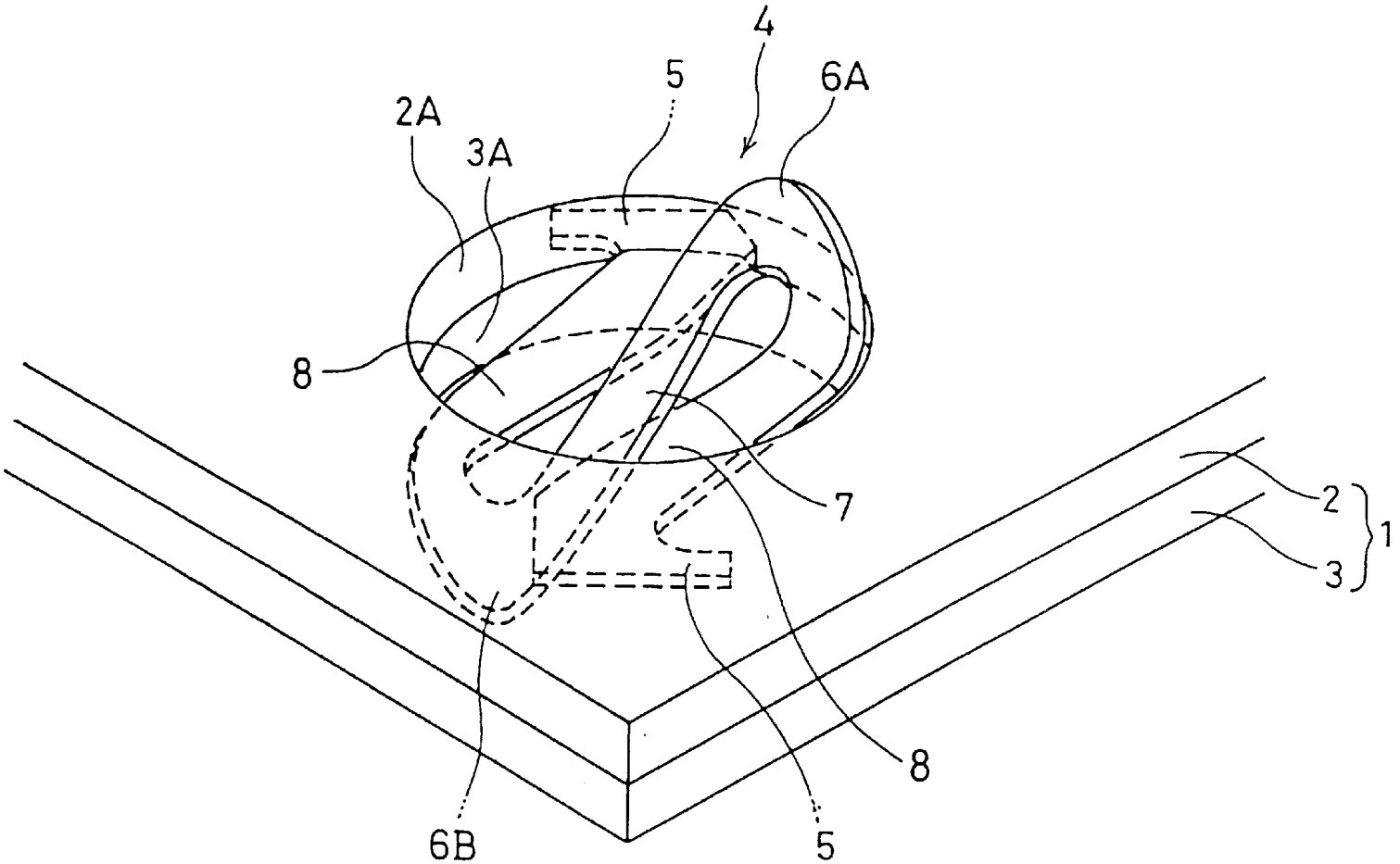
FIG. 1 is a perspective view of an intermediate electrical connector according to an embodiment of the invention.

In FIG. 1, a flat housing 1 consists of two insulating sheets 2 and 3 which are fixed to each other such that a plurality of apertures 2A and 3A are aligned.

A contact element is made by forming a substantially S-shaped strip of sheet metal such that retention sections 5 at opposite ends are provided outside the apertures 2A and 3A while contact sections 6A and 6B are subjected to such plastic deformation that they project vertically from the apertures 2A and 3A, respectively. The retention sections 5 are held between the insulating sheets 2 and 3 at the periphery of the apertures 2A and 3A.

A transmission path 7 extends substantially straight between the curved contact sections 6A and 6B. A spring section 8 is provided between the retention section 5 and a contact section 6A or 6B and is vertically flexible.

How to use the intermediate electrical connector will be described below.

Figure 2A:
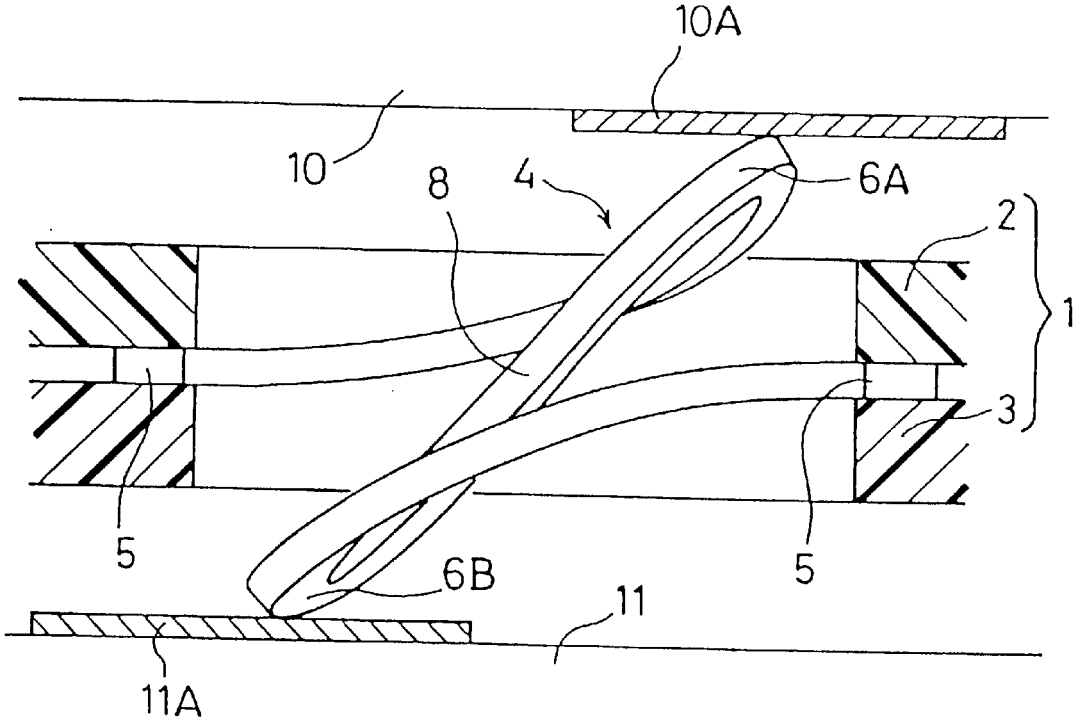
FIG. 2(A) is a side view, partially in section, of the intermediate electrical connector when connection is started.

(1) In FIG. 2(A), the contact element 4 are brought into contact with the connection circuits 10A and 11A of connection objects or circuit boards 10 and 11, but the contact sections 6A and 6B still project from the housing 1.

(2) The circuit boards 10 and 11 are moved toward the housing 1 to squeeze the contact sections 6A and 6B.

Figure 2B:
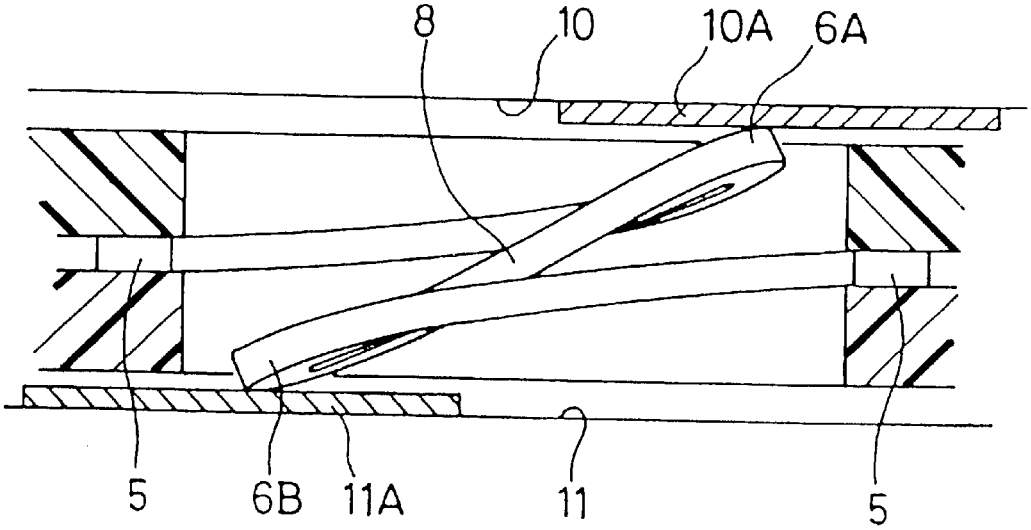
FIG. 2(B) is a side view, partially in section, of the intermediate electrical connector when connection is completed.

(3) In FIG. 2(B), the contact sections 6A and 6B are deflected vertically so that the connection circuits 10A and 11A are electrically connected via the transmission path 8 under a predetermined pressure. When the contact sections 6A and 6B undergo elastic deformation, they also move laterally, causing wiping effects and cleaning the contact surfaces.

How to produce the intermediate electrical connector will described below.

Figure 3C:
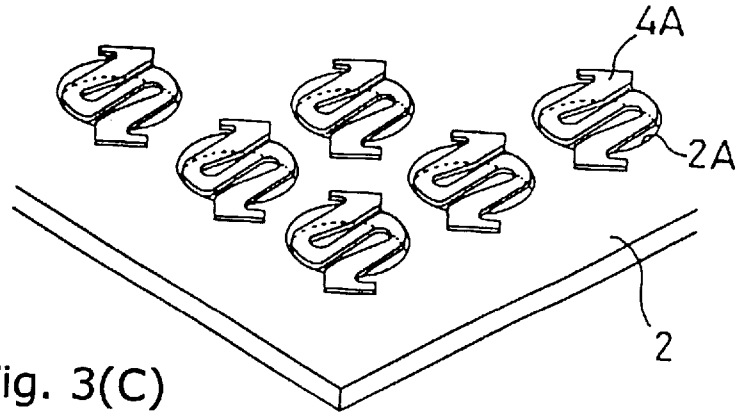
FIG. 3(C) is a perspective view of the first insulating sheet on which flat contact elements are formed.
Figure 3D:
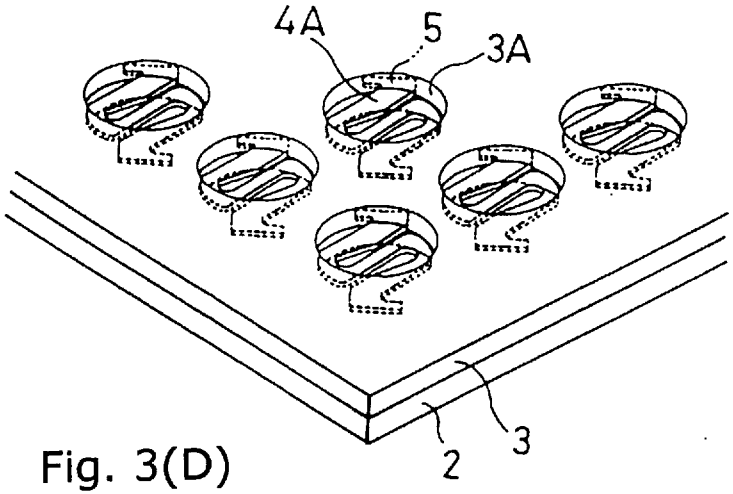
FIG. 3(D) is a perspective view of the first insulating sheet on which a second insulating sheet is attached.
Figure 3A:
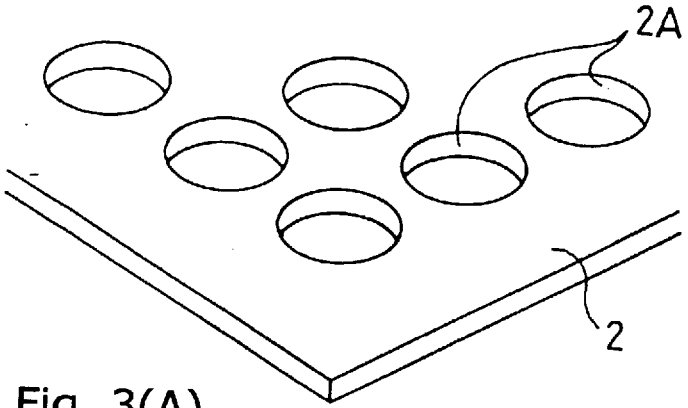
FIG. 3(A) is a perspective view of a first insulating sheet.

(1) In FIG. 3(A), a plurality of apertures 2A are opened by punching, etching, or cutting a first insulating sheet 2 which is made from an insulating material, such as polyimide, Alamide, or an engineering plastic.

Figure 3B:
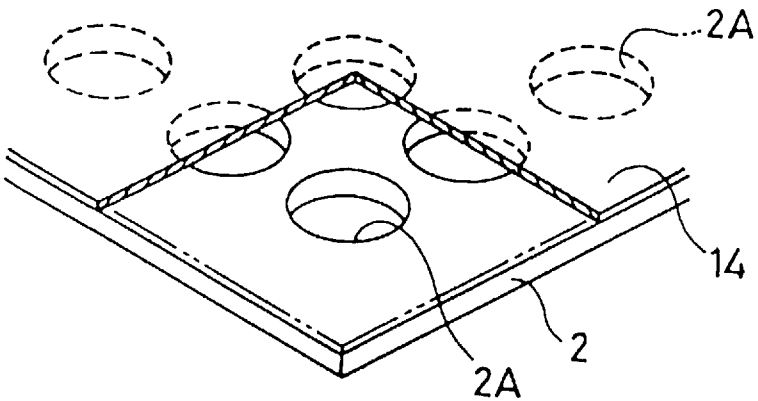
FIG. 3(B) is a perspective view of the first insulating sheet on which a metal sheet is provided.
Figure 4:
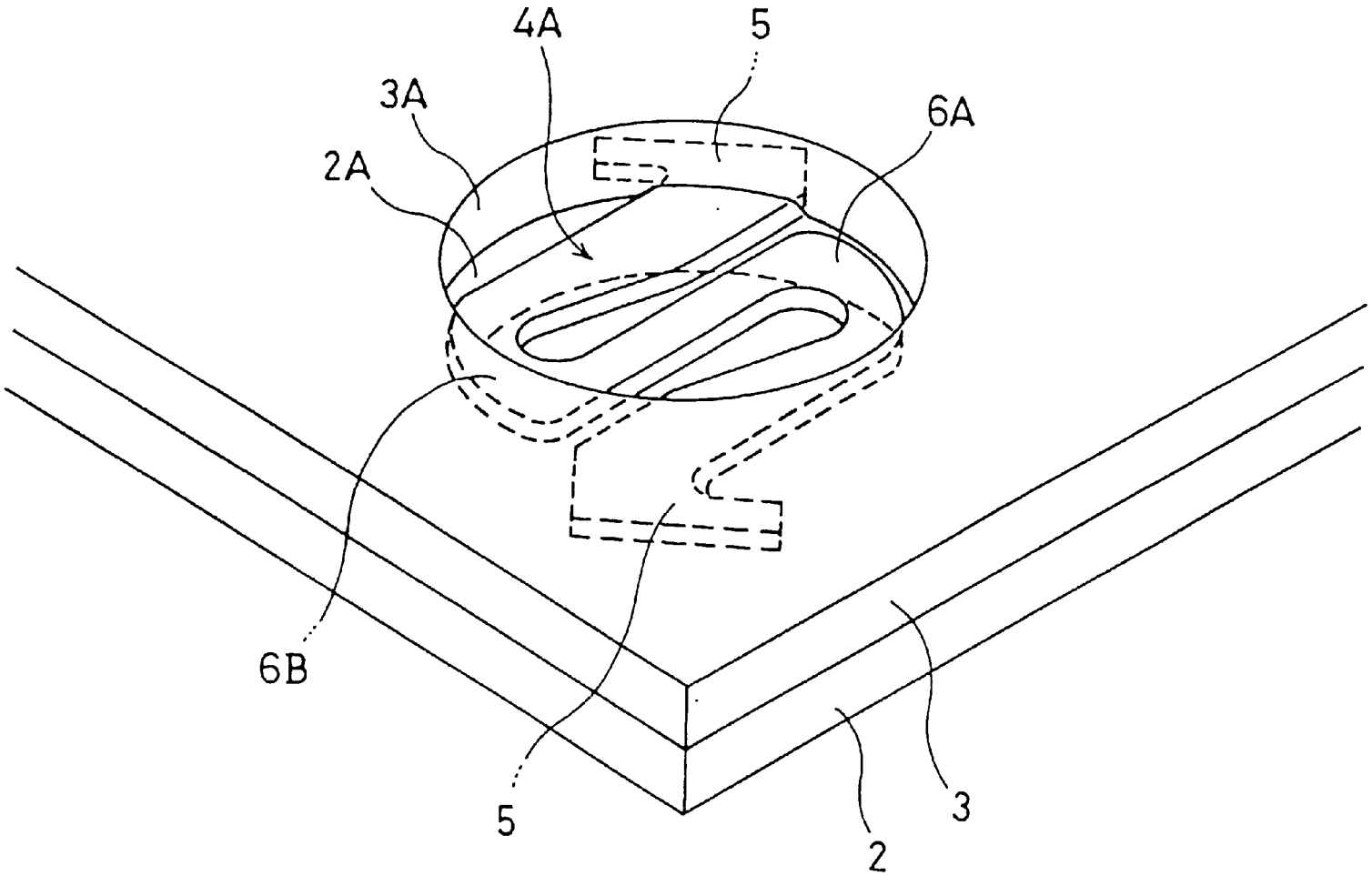
FIG. 4 is an enlarged perspective view of the flat contact element of FIG. 3(D)

(2) In FIG. 3(B), a sheet of metal 14, such as beryllium- or nickel-copper alloy, is bonded to the first insulating sheet 2. The thickness of the sheet varies with the width and length of the spring section of a contact element and the required contact pressure. Examples of the preferred bond are epoxy, phenol, and silicon resins. Alternatively, the sheet metal may be press-bonded under heat to the film.

(3) In FIG. 3(C), the metal sheet 14 is etched off to form flat contact elements 4A.

(4) In FIG. 3(D), a second insulating sheet 3 is bonded to the first insulating sheet 2 such that the apertures 2A and 3A are aligned so that the retention sections 5 of the flat contact elements 4A are held between the peripheries of the apertures 2A and 3A. The condition is shown in more detail in FIG. 4.

(5) The curved sections 6A and 6B are subjected to vertical plastic deformation in a press so that they project from the housing 1 upwardly and downwardly, respectively, forming the intermediate electrical connector having the contact sections 6A and 6B.

Alternatively, the insulating sheet 3 is replaced by applying a resin, such as polyimide, to the flat contact elements 4A and, prior to hardening of the resin, subjecting it to alkali etching to form apertures.

The forming of apertures by etching the metal sheet may be replaced by forming by a press. For example, a metal sheet is stamped in a press to form a series of flat contact elements, bonding it to the first insulating sheet, cutting the linking sections between the flat contact elements, and attaching or coating the second insulating sheet. The cutting the linking sections may be made by etching, laser, or stamping by a press.

The retention sections of a contact element may be inside an aperture of the housing. For example, the side surface of an aperture is provided with a step for engagement with the edge of a retention section.

Figure 5:
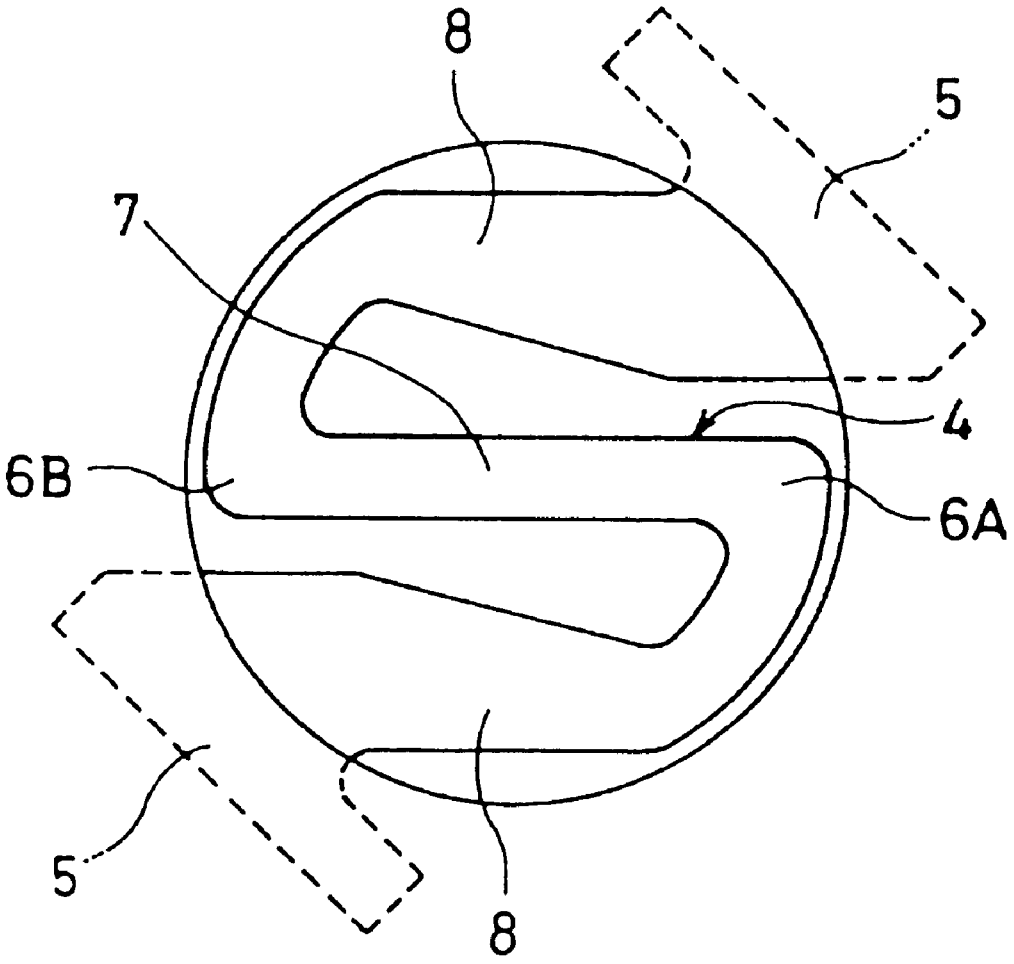
FIG. 5 is a top plan view of the flat contact element of FIG. 4.

The flat shape of the contact element of FIG. 1 is shown in FIG. 5. However, the shape may be modified in many ways as described bellow.

Figure 6:
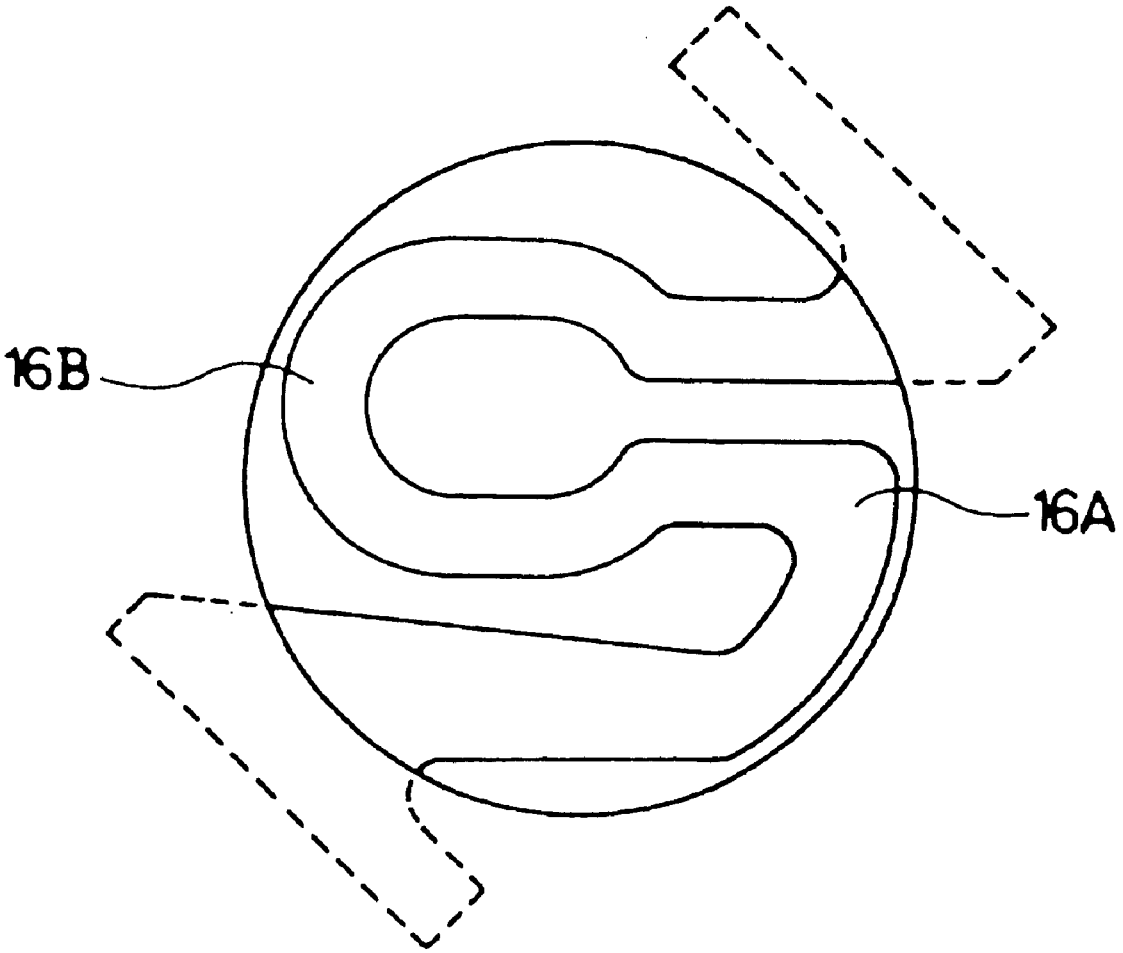
FIG. 6 is a top plan view of a flat contact element according another embodiment of the invention.

In FIG. 6, one of the contact sections 16B is made oval for receiving the spherical contact section of the connection object of FIG. 9. Since the spherical contact section is movable in the longitudinal direction of the oval contact section, wiping effects are produced.

Figure 7:
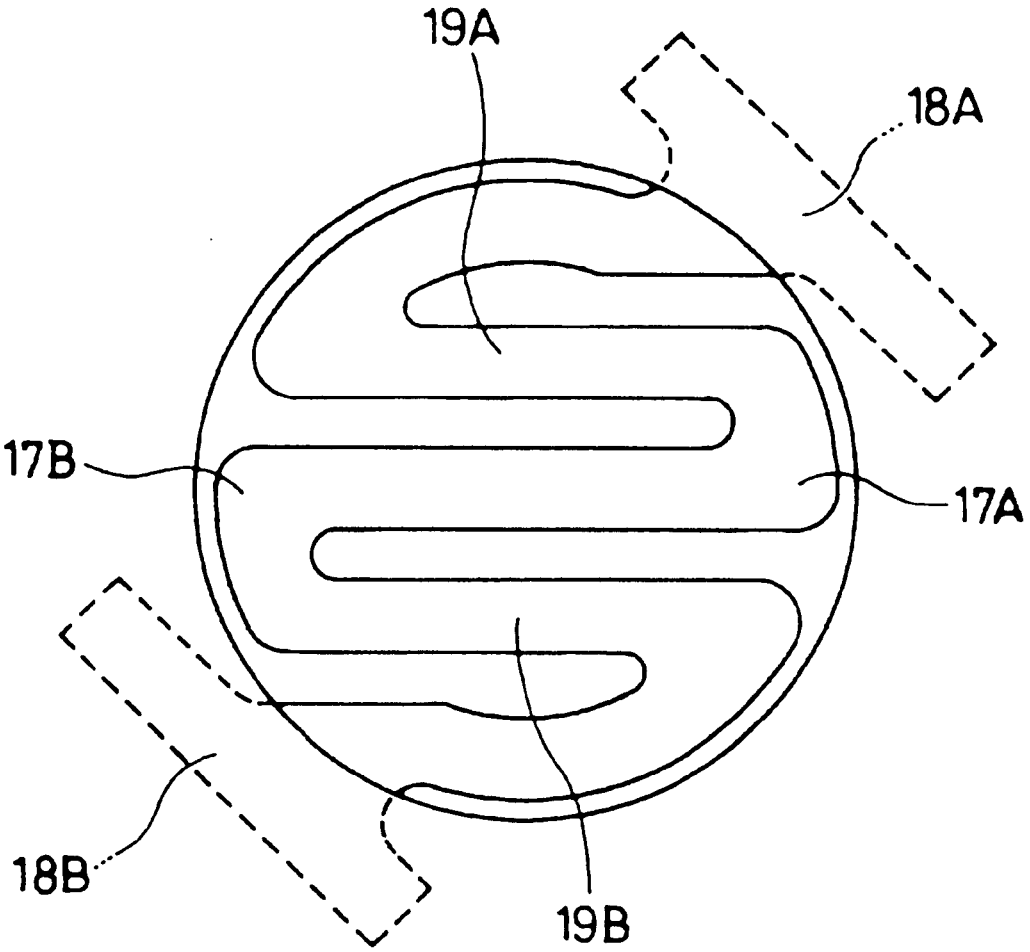
FIG. 7 is a top plan view of a flat contact element according to still another embodiment of the invention.

In FIG. 7, like the transmission path of FIG. 1, the transmission path between contact sections 17A and 17B is straight, but the spring sections 19A and 19B between the contact section 17A and the end section 18A and between the contact section 17B and the end section 18B are curved, respectively, and longer than the spring sections of FIG. 1. Consequently, they provide softer spring quality.

Figure 8:
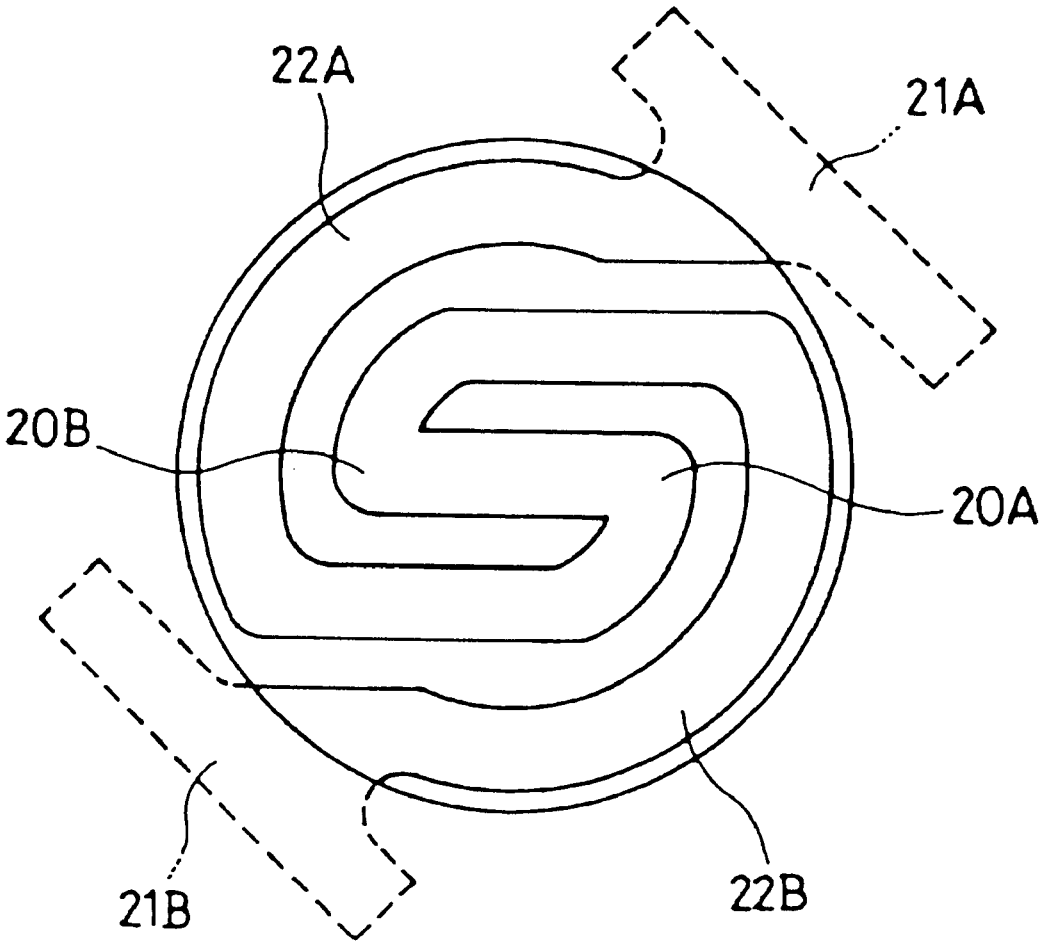
FIG. 8 is a top plan view of a flat contact element according to yet another embodiment of the invention.

Similarly, in FIG. 8, the spring sections 22A and 22B between the contact section 20A and the end section 21A and between the contact section 20B and the end section 21B are curved, respectively, and produce the same effects as those of FIG. 7.

As described above, the intermediate electrical connector according to the invention has a pair of contact sections made by forming a continuous strip of metal sheet with a pair of curved sections and subjecting the curved sections to vertical plastic deformation so that the distance or transmission path between the two contact sections is shortened to minimize the inductance and electrical resistance. In addition, there is only one transmission path so that there is no problem with signal delay. Furthermore, the two contact sections produce wiping effects to clean the contact area, making the contact stable.

In the process for making the intermediate electrical connector, a metal sheet is attached to the first insulating sheet with apertures, subjected to etching to form flat contact elements or flat contact elements are attached to the first insulating sheet and the second insulating sheet is attached to fix the flat contact elements, and the curved sections of the flat contact elements are subjected to vertical plastic deformation to form the contact sections so that it is possible to produce the contact sections by a very simple method. Even if the number of contact elements of an intermediate electrical connector increases, the number of process steps remains the same.

What is claimed is:

1. An intermediate electrical connector, comprising:

a plate-shaped housing having at least one aperture and a contact element accommodated in said aperture and made of a metal strip having a plurality of curves to resiliently contact with a pair of connection objects provided on opposite sides of said housing, thereby securing a firm electrical connection between said pair of said connection objects, said contact element including:

a pair of retention sections provided at opposite ends of said contact element and held by said housing;

a spring section extending from each of said retention sections;

a pair of U-shaped contact sections, one end of each of said U-shaped contact sections being connected to respective spring section such that said U-shaped contact sections project from said aperture and are flexed by said spring sections when said U-shaped contact sections make contact with said connection objects; and a transmission path connected between the other ends of said contact sections such that a length of said transmission path is minimized.

2. An intermediate electrical connector according to claim 1, wherein said retention sections are located outside said aperture.

3. An intermediate electrical connector according to claim 1, wherein said transmission path is substantially straight.

4. An intermediate electrical connector according to claim 1, wherein said housing consists of two layers between which said retention sections are held.

5. An intermediate electrical connector according to claim 2, wherein said housing consists of two layers between which said retention sections are held.

* * * * *